US011612980B2

(12) United States Patent
Sudo

(10) Patent No.: US 11,612,980 B2
(45) Date of Patent: Mar. 28, 2023

(54) GRINDING APPARATUS

(71) Applicant: DISCO CORPORATION, Tokyo (JP)

(72) Inventor: Yujiro Sudo, Tokyo (JP)

(73) Assignee: DISCO CORPORATION

( * ) Notice: Subject to any disclaimer, the term of this patent is extended or adjusted under 35 U.S.C. 154(b) by 92 days.

(21) Appl. No.: 17/149,119

(22) Filed: Jan. 14, 2021

(65) Prior Publication Data

US 2021/0237225 A1 Aug. 5, 2021

(30) Foreign Application Priority Data

Feb. 4, 2020 (JP) ..... JP2020-016990

(51) Int. Cl.
*B24B 41/06* (2012.01)
*B24B 41/02* (2006.01)
*B24B 7/22* (2006.01)

(52) U.S. Cl.
CPC ..... *B24B 41/068* (2013.01); *B24B 7/228* (2013.01); *B24B 41/02* (2013.01)

(58) Field of Classification Search
CPC ..... B24B 7/22; B24B 7/228; B24B 37/005; B24B 37/013; B24B 37/04; B24B 37/042; B24B 37/046; B24B 37/07; B24B 37/10; B24B 37/105; B24B 37/107; B24B 37/34; B24B 41/068; B24B 41/02
USPC ..... 451/64
See application file for complete search history.

(56) References Cited

U.S. PATENT DOCUMENTS 5,562,523 A * 10/1996 Asano ..... G05B 19/4166 451/5
6,656,818 B1 * 12/2003 Kishimoto ..... H01L 21/02013 438/692
8,025,553 B2 * 9/2011 Sekiya ..... B24B 7/228 451/63

(Continued)

FOREIGN PATENT DOCUMENTS

JP 2009090389 A 4/2009
JP 2017104952 A 6/2017
JP 2017104952 A * 6/2017

OTHER PUBLICATIONS

Machine Translation of desciption of JP-2017-104952 (Year: 2017).*

(Continued)

*Primary Examiner* — Don M Anderson
*Assistant Examiner* — Jason Khalil Hawkins
(74) *Attorney, Agent, or Firm* — Greer, Burns & Crain, Ltd.

(57) ABSTRACT

A grinding apparatus includes a chuck table for holding a workpiece thereon, a table base supporting the chuck table, a grinding unit for grinding the workpiece held on the chuck table with a grinding wheel mounted on an end of a spindle, a load detecting unit for detecting a load applied from the grinding unit to the table base, a tilt adjustment unit supporting the table base thereon, for adjusting a tilt of the table base, a storage for storing a correlative relation between loads applied to the table base and changes in the tilt of the table base, and a controller for controlling the tilt adjustment unit based on the load detected by the load detecting unit and the correlative relation, to adjust the tilt of the table base so that a change in the tilt of the table base that corresponds to the detected load is cancelled out.

11 Claims, 10 Drawing Sheets

(56) References Cited

U.S. PATENT DOCUMENTS

| | | | | |
|---|---|---|---|---|
| 8,968,052 | B2 * | 3/2015 | Walsh | B24B 37/013 451/10 |
| 9,393,669 | B2 * | 7/2016 | Kalenian | B24B 49/00 |
| 9,656,370 | B2 * | 5/2017 | Yoshida | B24B 7/228 |
| 2004/0014401 | A1 * | 1/2004 | Tsao | B24B 49/12 451/57 |
| 2015/0239093 | A1 * | 8/2015 | Fukui | H01L 23/49524 451/5 |

OTHER PUBLICATIONS

Search report issued in counterpart Singapore patent application No. 10202100330Y, dated Feb. 18, 2022.

* cited by examiner

GRINDING APPARATUS

BACKGROUND OF THE INVENTION

Field of the Invention

The present invention relates to a grinding apparatus for grinding a workpiece and a grinding method for grinding a workpiece.

Description of the Related Art

Grinding apparatuses for grinding one surface of semiconductor wafers are used in the process of manufacturing semiconductor device chips. A grinding apparatus includes a chuck table for holding the other surface of a semiconductor wafer that is opposite the one surface thereof that is to be ground. A rotary actuator such as an electric motor for rotating the chuck table about its central axis, which is also referred to as a "rotational axis," is disposed beneath a lower portion of the chuck table. The rotary actuator has a rotational shaft coupled to the lower portion of the chuck table. The chuck table has an upper surface as a projecting conical surface that functions as a holding surface for attracting the semiconductor wafer under suction.

A grinding unit is disposed above the chuck table. The grinding unit has a cylindrical spindle having a lower end to which an upper surface of a disk-shaped mount is fixed. The disk-shaped mount has a lower surface with an annular grinding wheel mounted thereon. The grinding wheel includes an annular base made of metal and a plurality of grindstones disposed on a lower surface of the annular base. Each of the grindstones is in the form of a block. The grindstones have respective lower surfaces that jointly define a grinding surface for grinding the semiconductor wafer.

For grinding the one surface of a semiconductor wafer on the grinding apparatus, a protective tape made of resin is affixed to the other surface of the semiconductor wafer. Then, the other surface of the semiconductor wafer is held under suction on the holding surface of the chuck table with the protective tape interposed therebetween. At this time, the semiconductor wafer is elastically deformed into a projecting conical shape matching the projecting conical shape of the holding surface of the chuck table. The rotational axis of the chuck table is tilted at a predetermined angle with respect to the spindle such that the grinding surface of the grindstones lies substantially parallel to a local arcuate area of the one surface of the semiconductor wafer. To grind the one surface of the semiconductor wafer, the grinding wheel is processing-fed downwardly toward the semiconductor wafer on the chuck table while the chuck table and the grinding wheel are being rotated in respective directions. When the grinding surface is brought into contact with the local arcuate area of the one surface of the semiconductor wafer, the one surface of the semiconductor wafer is ground by the grindstones.

Semiconductor wafers that have been ground may have different thickness variations depending on the types of protective tapes used, the diameters of the semiconductor wafers, etc. There is known a process in which data of such thickness variations depending on the types of protective tapes used, etc., are collected in advance and, when a semiconductor wafer is to be ground, the angle of the spindle with respect to the rotational axis of the chuck table is automatically adjusted on the basis of the collected data (see, for example, Japanese Patent Laid-open No. 2009-90389).

However, on an ordinary grinding apparatus, the spindle is disposed substantially parallel to vertical directions and cannot be tilted from the vertical directions. Therefore, it has been customary to tilt the rotational axis of the chuck table rather than the spindle.

A tilt adjustment unit for adjusting the tilt of the rotational axis of the chuck table is disposed beneath the chuck table. The tilt adjustment unit includes a fixed support mechanism, a first movable support mechanism, and a second movable support mechanism, that support the chuck table at respective three points. When a semiconductor wafer is ground by the grinding apparatus, of the one surface of the semiconductor wafer, an arcuate local area to be ground by the grinding surface is positioned above a region between the fixed support mechanism and the first movable support mechanism. Therefore, a relatively large load is applied to the fixed support mechanism and the first movable support mechanism by the grinding surface. However, a load applied to the second movable support mechanism is relatively small compared with the load applied to the fixed support mechanism and the first movable support mechanism.

SUMMARY OF THE INVENTION

Consequently, while the semiconductor wafer is being ground by the grinding apparatus, the tilt of the chuck table tends to change, resulting in larger thickness variations of the semiconductor wafer.

The present invention has been made in view of the above problems. It is an object of the present invention to provide a grinding apparatus that prevents thickness variations of a semiconductor wafer that is ground from becoming worse even when a large grinding load is locally applied to a chuck table that is holding the semiconductor wafer thereon.

In accordance with an aspect of the present invention, there is provided a grinding apparatus for grinding a workpiece, including a chuck table for holding the workpiece thereon, a plate-shaped table base supporting the chuck table, a grinding unit for grinding the workpiece held on the chuck table with a grinding wheel, the grinding unit having a spindle and the grinding wheel mounted on an end of the spindle, a load detecting unit having load measuring devices, for detecting a load applied from the grinding unit to the table base, a tilt adjustment unit supporting the table base thereon, for adjusting a tilt of the table base, a storage for storing a correlative relation between loads applied to the table base and changes in the tilt of the table base that are caused by the loads, and a controller having a processor, for controlling the tilt adjustment unit on the basis of the load detected by the load detecting unit and the correlative relation, to adjust the tilt of the table base so that a change in the tilt of the table base that corresponds to the detected load is cancelled out.

Preferably, the tilt adjustment unit has a fixed support mechanism and a plurality of movable support mechanisms, the correlative relation represents a correlative relation between loads applied to the fixed support mechanism and the movable support mechanisms and changes in the tilt of the table base that are caused by respective contractions of the fixed support mechanism and the movable support mechanisms to which the loads are applied, and the controller adjusts respective lengths of the movable support mechanisms on the basis of the correlative relation, thereby adjusting the tilt of the table base.

In accordance with another aspect of the present invention, there is provided a grinding method for grinding a workpiece, including a first tilt adjusting step of adjusting a tilt of a table base that supports a chuck table, in order to make parallel to each other a grinding surface defined by respective lower surfaces of grindstones of a grinding wheel that are disposed on a surface of a wheel base and arrayed along circumferential directions of the surface of the wheel base and a local area of a holding surface of the chuck table that overlaps an area of contact between the grindstones and the workpiece held on the chuck table; after the first tilt adjusting step, a first grinding step of grinding the workpiece with the grinding wheel and detecting a load applied to the table base; after the first grinding step, a second tilt adjusting step of adjusting the tilt of the table base in order to cancel out a change in the tilt of the table base that corresponds to the load detected in the first grinding step, on the basis of the correlative relation between loads applied to the table base and changes in the tilt of the table base that are caused by the loads and the load detected in the first grinding step; and after the second tilt adjusting step, a second grinding step of grinding the workpiece to a predetermined finished thickness.

Preferably, the correlative relation represents a correlative relation between loads applied to a fixed support mechanism and a plurality of movable support mechanisms and changes in the tilt of the table base that are caused by respective contractions of the fixed support mechanism and the movable support mechanisms to which the loads are applied, the fixed support mechanism and the plurality of movable support mechanisms being configured to adjust the tilt of the table base, and the second tilt adjusting step includes a step of adjusting respective lengths of the movable support mechanisms on the basis of the loads applied to the fixed support mechanism and the movable support mechanisms and the correlative relation.

Preferably, the grinding method further includes, after the second grinding step, a third grinding step of holding another workpiece different from the workpiece and grinding the other workpiece with the grinding wheel while the lengths of the movable support mechanisms remain to have lengths adjusted in the second tilt adjusting step.

Preferably, the third grinding step includes a step of detecting a load applied to the table base as well as grinding the other workpiece with the grinding wheel, the grinding method further including a third tilt adjusting step of adjusting the tilt of the table base in order to cancel out a change in the tilt of the table base that corresponds to the load detected in the third grinding step, on the basis of the load detected in the third grinding step and the correlative relation.

The grinding apparatus according to the aspect of the present invention includes the storage for storing the correlative relation between loads applied to the table base and changes in the tilt of the table base. The grinding apparatus also includes the controller for controlling the tilt adjustment unit on the basis of the load detected by the load detecting unit and the correlative relation stored in the storage. The controller adjusts the tilt of the table base in order to cancel out a change in the tilt of the table base that corresponds to the detected load. Consequently, thickness variations of the workpiece are prevented from becoming worse compared with a case in which the tilt of the table base is not adjusted.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
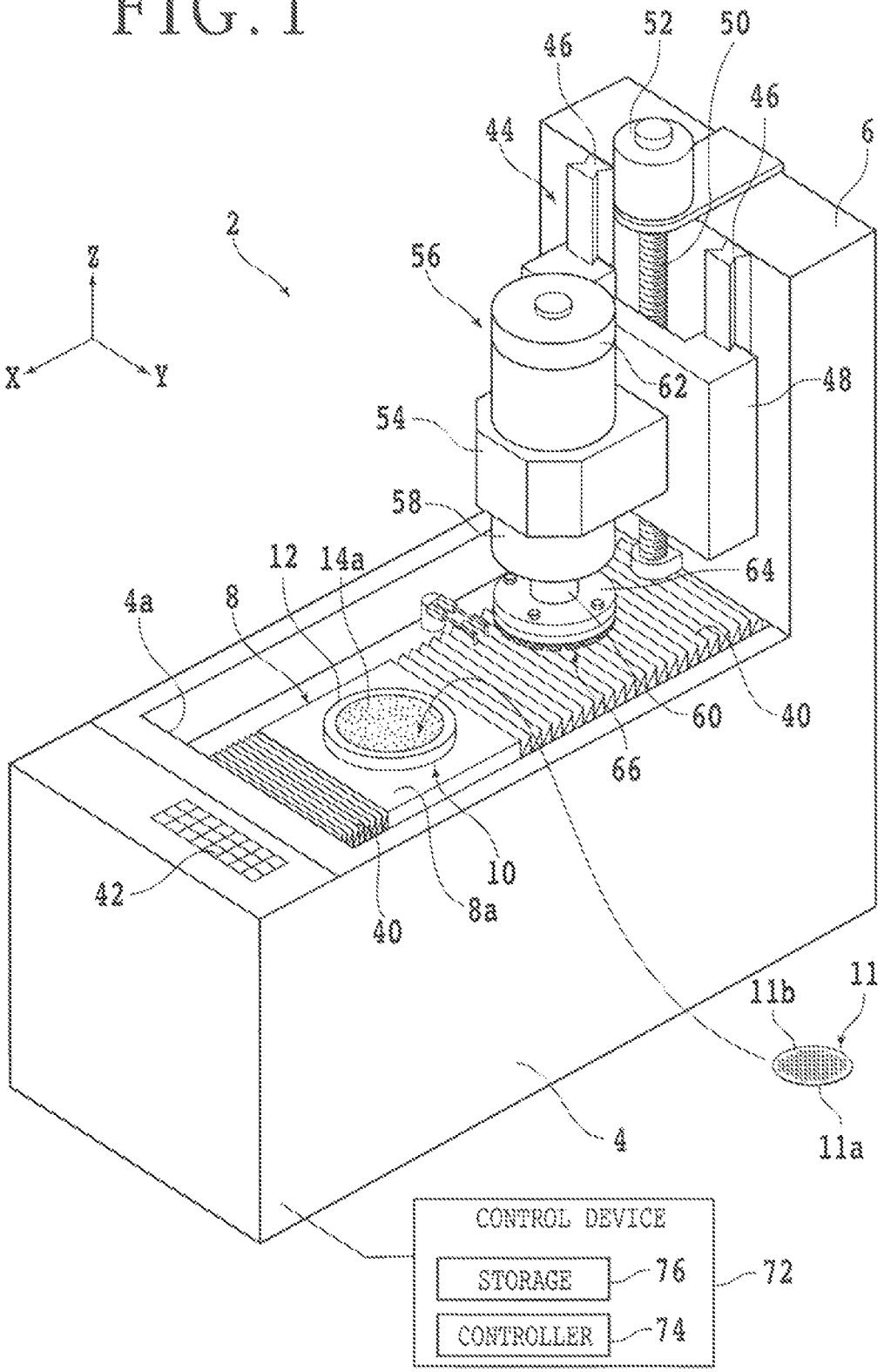
FIG. 1 is a perspective view illustrating a structural example of a grinding apparatus according to a preferred embodiment of the present invention.

A grinding apparatus according to a preferred embodiment of the present invention will be described in detail below with reference to the accompanying drawings. FIG. 1 illustrates in perspective view a structural example of the grinding apparatus, denoted by 2. In FIG. 1, some components of the grinding apparatus 2 are illustrated as functional blocks. In FIG. 1, X-axis, Y-axis, and Z-axis directions represent directions perpendicular to each other. The Z-axis directions are also referred to as vertical directions, upward and downward directions, or grinding-feed directions.

The grinding apparatus 2 includes a base 4 on which the components of the grinding apparatus 2 are mounted. The base 4 has a rectangular opening 4*a* defined in an upper surface thereof and extending longitudinally along the X-axis directions. The opening 4*a* houses therein a ball-screw-type X-axis moving mechanism 8. The X-axis moving mechanism 8 has an unillustrated pair of guide rails extending along the X-axis directions and an unillustrated ball screw disposed between the guide rails and extending along the X-axis directions. An unillustrated stepping motor is coupled to an end of the ball screw for rotating the ball screw about its central axis.

The ball screw is operatively threaded through an unillustrated nut mounted on a lower surface of an unillustrated X-axis movable table. When the stepping motor is energized, it rotates the ball screw about its central axis, causing the nut to move the X-axis movable table along the X-axis directions. A table cover 8*a* is disposed on the X-axis movable table, and a chuck table 10 is mounted as a holding table on the table cover 8*a*.

Figure 2:
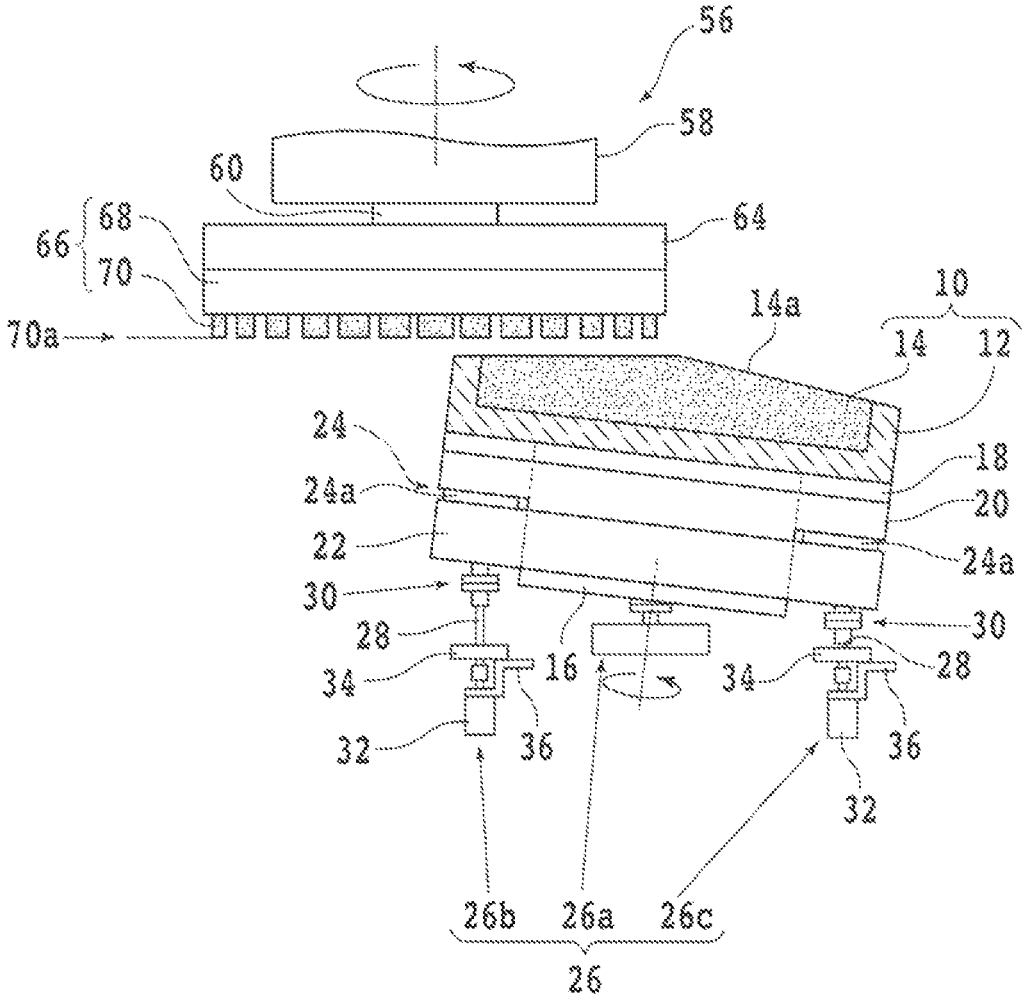
FIG. 2 is a side elevational view, partly in cross section, of a chuck table and other components of the grinding apparatus.

Structural details of the chuck table 10 will be described below with reference to FIG. 2. FIG. 2 illustrates in side elevation, partly in cross section, of the chuck table 10 and other components of the grinding apparatus 2. The chuck table 10 has a disk-shaped frame 12 made of ceramic. The frame 12 has a disk-shaped recess defined therein that is open upwardly. The frame 12 has an unillustrated suction channel that is defined in the bottom of the recess and that has an end exposed on the bottom of the recess and another end connected to an unillustrated suction source such as an ejector. A porous plate 14 is fixedly disposed in the recess. The porous plate 14 has a substantially flat lower surface and a conical upper surface including a central area slightly protruding upwardly compared with an outer circumferential area thereof. When the suction source is actuated, it generates a negative pressure that acts through the suction channel and the porous plate 14 on the conical upper surface thereof that acts as a holding surface 14*a*.

A cylindrical rotational shaft 16 has an upper portion coupled to a lower portion of the chuck table 10. The rotational shaft 16 is provided by the output shaft of an unillustrated rotary actuator such as a servomotor. When the rotary actuator is energized, it rotates the rotational shaft 16 about its central axis, rotating the chuck table 10 about the central axis of the rotational shaft 16. The chuck table 10 is rotatably supported on an annular bearing 18 that is disposed on a lower surface of the chuck table 10 around the rotational shaft 16. An annular support plate 20 is fixed to a lower surface of the bearing 18 around the rotational shaft 16.

An annular plate-shaped table base 22 is disposed beneath the support plate 20 around the rotational shaft 16. A load detecting unit 24 is disposed between a flat lower surface of the support plate 20 and a flat upper surface of the table base 22. The load detecting unit 24 has three load measuring devices 24*a* that are circumferentially spaced from each other on the upper surface of the table base 22. The load measuring devices 24*a* have respective upper surfaces held in contact with the lower surface of the support plate 20. Each of the load measuring devices 24*a* is a diaphragm-type load cell, for example, though it may be a column-type load cell. The load cell includes a sensor for converting a load into an electric signal. The load sensor includes a piezoelectric sensor having a piezoelectric device, for example, though it may include a strain gauge sensor, an electrostatic capacitance sensor, or the like.

The chuck table 10 is supported on the table base 22 with the bearing 18, the support plate 20, and the load detecting unit 24 interposed therebetween. Thus, when the holding surface 14*a* is pressed downwardly, the load, i.e., grinding load, applied to the table base 22 through the holding surface 14*a* is measured by the load detecting unit 24. Three support mechanisms including a fixed support mechanism 26*a*, a first movable support mechanism 26*b*, and a second movable support mechanism 26*c* that are spaced from each other in circumferential directions of the table base 22 are disposed on a lower surface of the table base 22. Each of the support mechanisms is positioned directly below one of the load measuring devices 24*a*. These three supporting mechanisms will hereinafter collectively be referred to as a "tilt adjustment unit 26" in the present description.

The table base 22 is supported at one location by the fixed support mechanism 26*a*. The fixed support mechanism 26*a* has a support post, i.e., fixed shaft, having a predetermined length. The support post has an upper portion fixed to an upper support body fixed to the lower surface of the table base 22 and a lower portion fixed to a support base. The table base 22 is also supported at two other locations respectively by the first movable support mechanism 26*b* and the second movable support mechanism 26*c*. Each of the first movable support mechanism 26*b* and the second movable support mechanism 26*c* has a support post, i.e., movable shaft, 28 having an externally threaded distal upper end portion.

The externally threaded distal upper end portions of the support posts 28 are rotatably coupled to respective upper support bodies 30 that are fixed to the lower surface of the table base 22. More specifically, the upper support bodies 30 are shaped as columnar members made of metal such as rods having internally threaded holes defined therein. The externally threaded distal upper end portions of the support posts 28 are rotatably threaded in the internally threaded holes in the upper support bodies 30. The support posts 28 of the first movable support mechanism 26*b* and the second movable support mechanism 26*c* have outer circumferential surfaces fixed to respective ring-shaped bearings 34 having a predetermined diameter. The bearings 34 are supported on respective stepped support plates 36. Thus, the first movable support mechanism 26*b* and the second movable support mechanism 26*c* are supported by the support plates 36.

The support posts 28 have respective lower portions coupled to respective stepping motors 32 that rotate the support posts 28 about their central axes. When the stepping motors 32 are energized, they rotate the support posts 28 in one direction about their central axes, lifting the upper support bodies 30. When the stepping motors 32 are reversed, they rotate the support posts 28 in the other direction about their central axes, lowering the upper support bodies 30. The upper support bodies 30 are thus lifted or lowered to adjust the tilt of the table base 22, i.e., the chuck table 10. The lengths in the Z-axis directions of the fixed support mechanism 26*a*, the first movable support mechanism 26*b*, and the second movable support mechanism 26*c* may be reduced or contracted under a load applied downwardly to the table base 22. For example, the distance between the support post and the upper support body of the fixed support mechanism 26*a* may be reduced and the distances between the support posts 28 and the upper support bodies 30 of the first movable support mechanism 26*b* and the second movable support mechanism 26*c* may be reduced, so that the support mechanisms 26*a*, 26*b*, and 26*c* may be elastically contracted.

Referring back to FIG. 1, other components of the grinding apparatus 2 will be described below. The opening 4*a* is covered with a pair of bellows-shaped dust-proof, drip-proof covers 40 disposed respectively on both sides of the table cover 8*a* in the X-axis directions. The dust-proof, drip-proof covers 40 are extensible and contractible in the X-axis directions as the X-axis movable table moves in the X-axis directions. An operating panel 42 for entering grinding conditions, etc., is disposed on the upper surface of the base 4 at one end thereof in the X-axis directions. A support structure 6 in the shape of a rectangular parallelepiped projects upwardly from the base 4 at the other end thereof in the X-axis directions.

The support structure 6 supports a Z-axis moving mechanism 44 on a front surface thereof that faces the operating panel 42. The Z-axis moving mechanism 44 includes a pair of Z-axis guide rails 46 extending along the Z-axis directions and a Z-axis movable plate 48 slidably mounted on the Z-axis guide rails 46 for sliding movement along the Z-axis directions. An unillustrated nut is mounted on a rear surface of the Z-axis movable plate 48 that faces the support structure 6.

The nut is operatively threaded over a Z-axis ball screw 50 disposed between the Z-axis guide rails 46 and extending along the Z-axis directions. The Z-axis ball screw 50 is rotatable about its central axis. A Z-axis stepping motor 52 is coupled to an end of the Z-axis ball screw 50 in the Z-axis directions. When the Z-axis stepping motor 52 is energized, it rotates the Z-axis ball screw 50 about its central axis, causing the nut to move the Z-axis movable plate 48 in the Z-axis directions along the Z-axis guide rails 46. A support block 54 is mounted on a front surface of the Z-axis movable plate 48 that faces the operating panel 42.

The support block 54 supports a grinding unit 56 thereon. The grinding unit 56 has a hollow cylindrical spindle housing 58 fixed to the support block 54. A cylindrical spindle 60 extending along the Z-axis directions has a portion rotatably housed in the spindle housing 58 and projects below the spindle housing 58. The spindle 60 has an upper end to which there is coupled a servomotor 62 for rotating the spindle 60 about its central axis. The spindle 60 has a lower end exposed from the spindle housing 58 and fixed to an upper surface of a disk-shaped wheel mount 64 made of a metal material such as stainless steel.

The wheel mount 64 has a lower surface on which an annular grinding wheel 66 that is of substantially the same diameter as the wheel mount 64 is mounted. As illustrated in FIG. 2, the grinding wheel 66 has an annular wheel base 68 made of a metal material such as stainless steel and a plurality of grindstones 70 disposed on a lower surface of the wheel base 68 and spaced from each other in circumferential directions thereof. The grindstones 70 have lower surfaces lying at the substantially same vertical positions as each other in the Z-axis directions and jointly defining a grinding surface 70*a* for grinding a workpiece 11 (see FIGS. 3A and 3B).

The workpiece 11 that is held under suction on the holding surface 14*a* is ground by the grinding wheel 66. As illustrated in FIG. 1, the workpiece 11 is a semiconductor wafer, for example, that is made mainly of silicon carbide (SiC) and that has a diameter of approximately 150 mm. Devices such as integrated circuits (ICs) are disposed on a face side 11*a* of the workpiece 11. The workpiece 11 may be made of any material other than silicon carbide, e.g., gallium arsenide (GaAs), gallium nitride (GaN), silicone (Si), sapphire, and so on.

Figure 3A:
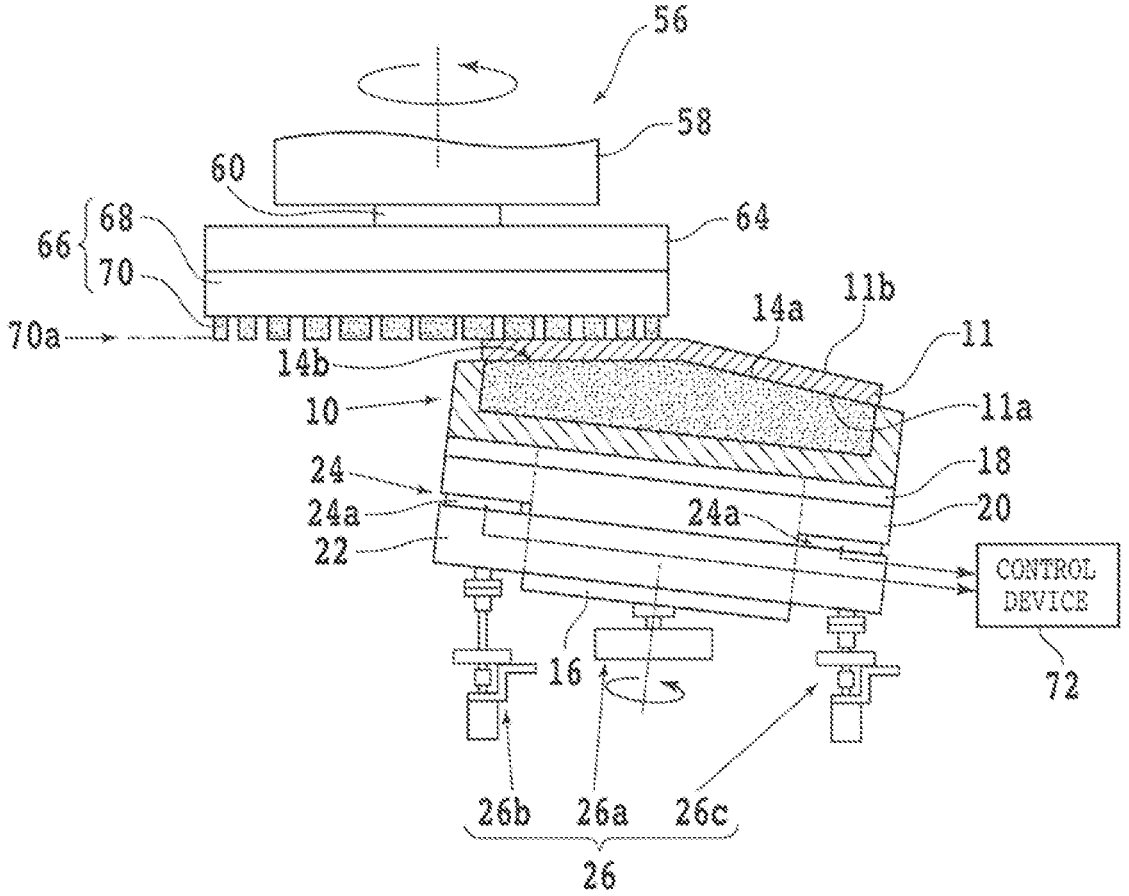
FIG. 3A is a side elevational view, partly in cross section, of the chuck table and other components.
Figure 3B:
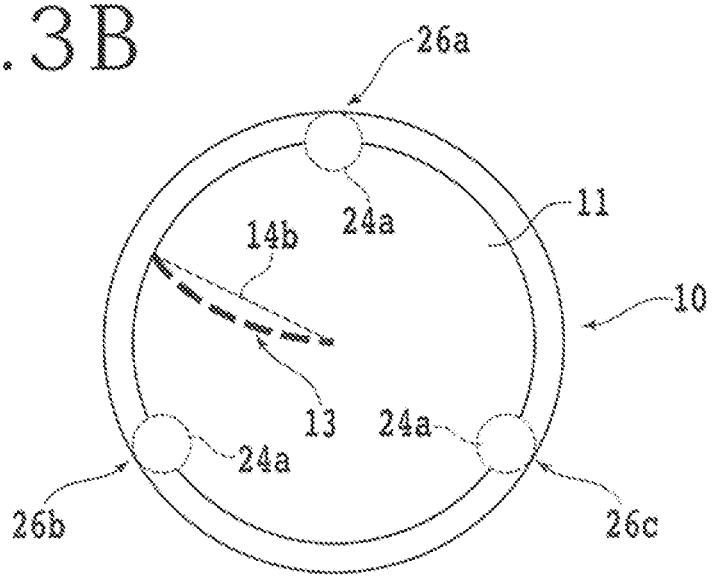
FIG. 3B is a plan view of the chuck table at the time a workpiece held on the chuck table is being ground.

An unillustrated protective tape for protecting the devices is affixed to the face side 11*a* of the workpiece 11. For grinding a reverse side 11*b* of the workpiece 11, the face side 11*a* thereof is held under suction on the holding surface 14*a* of the chuck table 10. Since the holding surface 14*a* is of the upwardly projecting conical shape, the workpiece 11 held under suction on the holding surface 14*a* is elastically deformed into a projecting conical shape matching the projecting conical shape of the holding surface 14*a*. When the reverse side 11*b* of the workpiece 11 on the holding surface 14*a* is ground by the grinding unit 56, the rotational shaft 16 is tilted such that the grinding surface 70*a* and a local area 14*b* of the holding surface 14*a* that faces the grinding surface 70*a* lie parallel to each other. FIG. 3A illustrates in side elevation, partly in cross section, the chuck table 10 and other components, illustrating the manner in which the workpiece 11 on the holding surface 14*a* is ground by the grindstones 70 while the grinding surface 70*a* and the local area 14*b* of the holding surface 14*a* lie substantially parallel to each other. FIG. 3B illustrates in plan the chuck table 10 at the time the workpiece 11 is being ground.

While the grinding wheel 66 and the chuck table 10 are being rotated about their respective central axes in a predetermined direction, e.g., counterclockwise as viewed in plan, the grinding wheel 66 is grinding-fed, i.e., is moved downwardly, toward the workpiece 11 on the holding surface 14*a*. Then, of the reverse side 11*b* of the workpiece 11, a local arcuate area that is positioned on the local area 14*b* of the holding surface 14*a*, i.e., a local arcuate area of the reverse side 11*b* that overlaps the local area 14*b* of the holding surface 14*a*, is brought into contact with the grinding surface 70*a* and thereby ground. In FIG. 3B, an area 13 of contact between the grinding surface 70*a* and the reverse side 11*b* of the workpiece 11, i.e., a ground area, is indicated by the arcuate thick broken line. Furthermore, the load measuring devices 24*a* are indicated by broken-line circles in FIG. 3B.

Figure 4:
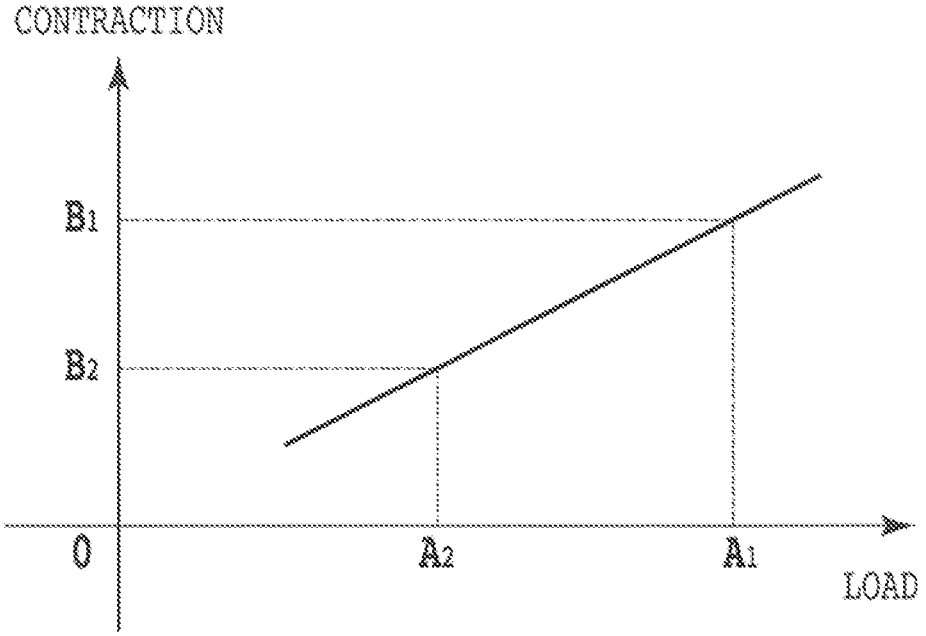
FIG. 4 is a graph illustrating, by way of example, the corresponding relation between loads applied to support mechanisms and contractions of the support mechanisms.

As illustrated in plan in FIG. 3B, the area 13 of contact is positioned directly above a region between the fixed support mechanism 26*a* and the first movable support mechanism 26*b*. Thus, when the grinding wheel 66 presses the workpiece 11 on the chuck table 10, it applies a larger load to the fixed support mechanism 26*a* and the first movable support mechanism 26*b* as compared to the second movable support mechanism 26*c*. FIG. 4 is a graph illustrating, by way of example, the corresponding relation between loads applied to the support mechanisms 26*a*, 26*b*, and 26*c* and contractions of the support mechanisms 26*a*, 26*b*, and 26*c*. In FIG. 4, the corresponding relation is illustrated as the same for the different support mechanisms 26*a*, 26*b*, and 26*c*, for the sake of convenience. However, the corresponding relation may be different for the different support mechanisms 26*a*, 26*b*, and 26*c*. The corresponding relation may be acquired by grinding on the grinding apparatus 2 a wafer for test processing with no devices formed thereon, for example.

When the grinding wheel 66 is grinding-fed into contact with the workpiece 11 on the chuck table 10, the workpiece 11 is pressed and ground by the grinding wheel 66. Since the area 13 of contact is positioned directly above the region between the fixed support mechanism 26*a* and the first movable support mechanism 26*b*, as described above, the load, indicated by $A_1$ in FIG. 4, applied to the fixed support mechanism 26*a* and the first movable support mechanism 26*b* is larger than the load, indicated by $A_2$ in FIG. 4, applied to the second movable support mechanism 26*c*. Consequently, the contraction, indicated by $B_1$ in FIG. 4, of the fixed support mechanism 26*a* and the first movable support mechanism 26*b* is larger than the contraction, indicated by $B_2$ in FIG. 4, of the second movable support mechanism 26*c*. The table base 22 is thus tilted from its state that is the state immediately before the workpiece 11 is ground by the grinding wheel 66. Accordingly, the tilt of the table base 22 changes due to the contractions of the support mechanisms 26*a*, 26*b*, and 26*c*.

For example, when the workpiece 11 is pressed and ground by the grinding wheel 66, it is assumed that the fixed support mechanism 26*a* and the first movable support mechanism 26*b* are contracted 2 μm in a downward direction, i.e., one of the Z-axis directions, by the loads applied thereto and that the second movable support mechanism 26*c* is contracted 1 μm in the same Z-axis direction by the load applied thereto. In this case, the table base 22 changes to a first tilted state from its state that is the state immediately before the workpiece 11 is ground. On the other hand, if the fixed support mechanism 26*a* is contracted 1 μm in the Z-axis direction by the load applied thereto and the first movable support mechanism 26*b* is contracted 2 μm in the Z-axis direction by the load applied thereto, then the table base 22 changes to a second tilted state from its state that is the state immediately before the workpiece 11 is ground. In this manner, the tilt of the table base 22 changes differently due to the contractions of the support mechanisms 26*a*, 26*b*, and 26*c*.

In order to examine changes in the tilt of the table base 22 that occur while the workpiece 11 is being ground, the loads imposed on the support mechanisms 26*a*, 26*b*, and 26*c* are measured by the load measuring devices 24*a*. Information regarding the measured loads is sent from the load measuring devices 24*a* to a control device 72 (see FIGS. 1 and 3A). The control device 72 is configured as a computer that includes, for example, a processing unit such as a processor, typically a central processing unit (CPU), a main storage unit such as a dynamic random access memory (DRAM), a static random access memory (SRAM), or a read only memory (ROM), and an auxiliary storage unit such as a flash memory, a hard disk drive, or a solid state drive.

The control device 72 has its functions realized by operating the processing unit, etc., according to software stored in the auxiliary storage unit, for example. Part of the auxiliary storage unit functions as a storage 74 for storing the corresponding relation between loads detected by the load measuring devices 24*a* and contractions of the support mechanisms 26*a*, 26*b*, and 26*c*, i.e., the correlative relation between detected loads and changes in the tilt of the table base 22. The corresponding relation between the detected loads and the contractions of the support mechanisms 26*a*, 26*b*, and 26*c* is stored in the form of an equation, a table, or the like in the storage 74. The storage 74 may alternatively be provided as a storage medium whose stored information can be read by an unillustrated reader of the control device 72. The storage medium may be a compact disc (CD), a digital versatile disc (DVD), a universal serial bus (USB) memory, a magnetoresistive memory, or the like.

The control device 72 has a controller 76 for controlling the operative mechanisms, etc., of the grinding apparatus 2. The controller 76 controls operation of the X-axis moving mechanism 8, the suction source and the rotary actuator for the chuck table 10, the tilt adjustment unit 26, the Z-axis moving mechanism 44, the servomotor 62, and so on. After having received measurement signals from the load measuring devices 24*a*, the controller 76 accesses the storage 74 at a predetermined timing. Then, the controller 76 reads contractions corresponding to the measured loads or calculates contractions from the corresponding relation between loads and contractions that is stored in the storage 74. Thereafter, the controller 76 controls operation of the stepping motors 32 of the first movable support mechanism 26*b* and the second movable support mechanism 26*c* of the tilt adjustment unit 26 in order to make the grinding surface 70*a* and the local area 14*b* of the holding surface 14*a* parallel to each other.

Figure 6A:
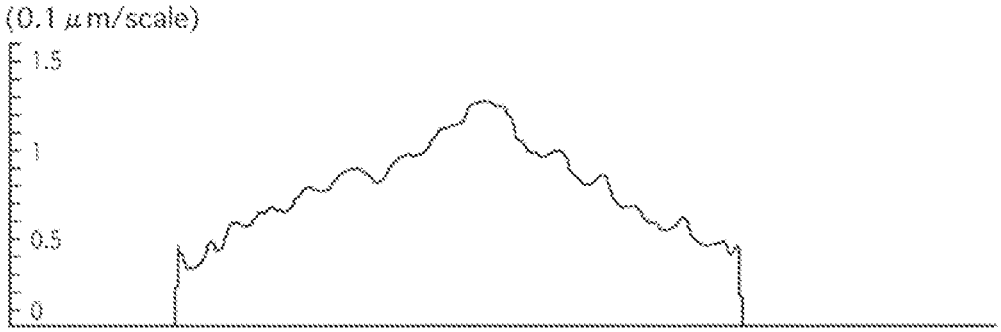
FIG. 6A is a diagram illustrating a cross-sectional profile of the reverse side of a workpiece ground under a grinding load of 30 N.
Figure 6B:
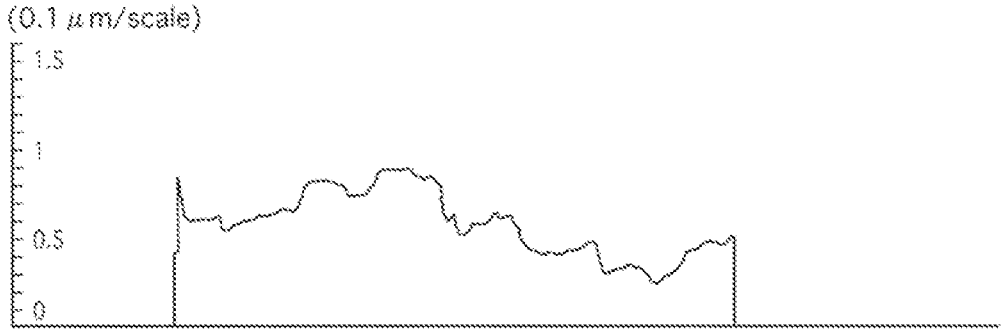
FIG. 6B is a diagram illustrating a cross-sectional profile of the reverse side of a workpiece ground under a grinding load of 60 N.
Figure 7:
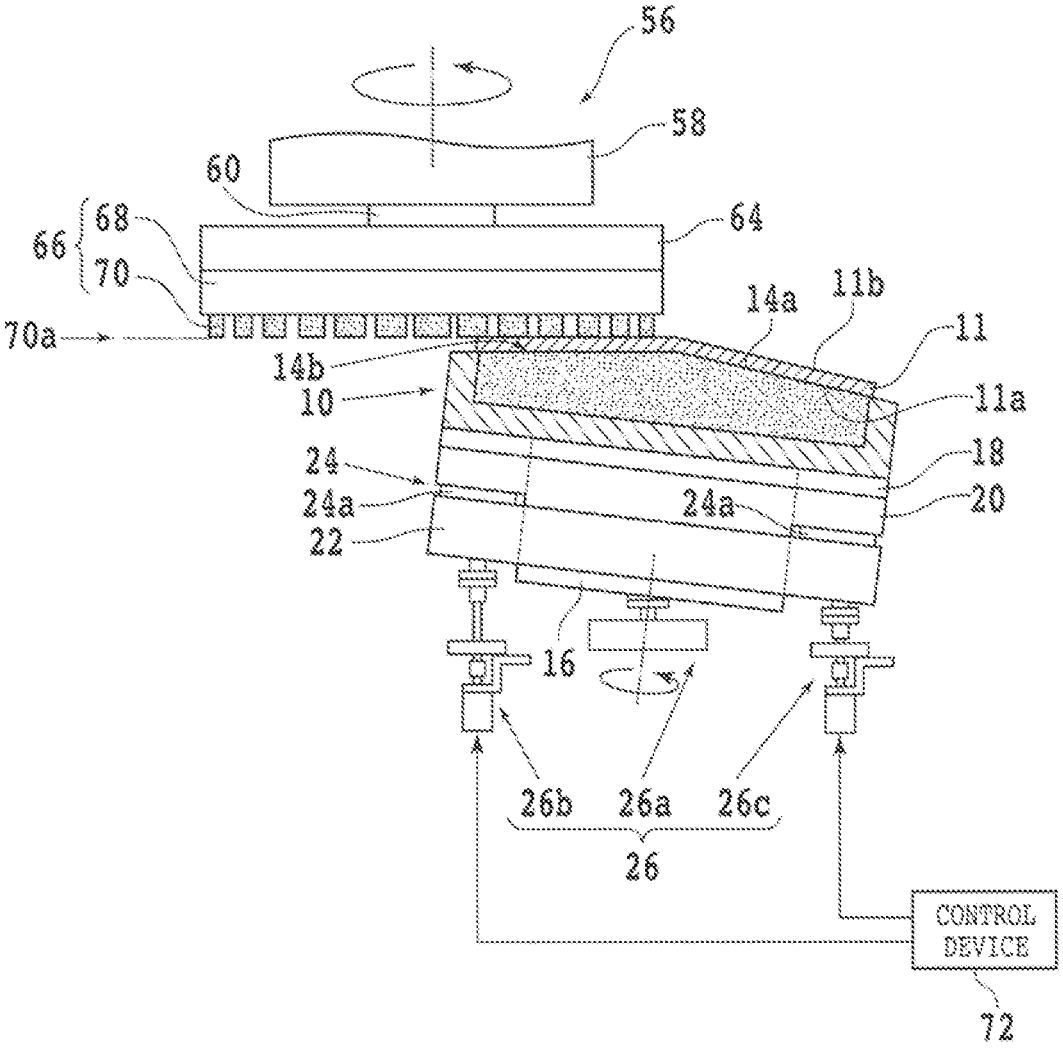
FIG. 7 is a side elevational view, partly in cross section, illustrating the manner in which a workpiece is ground by the grinding apparatus.
Figure 8:
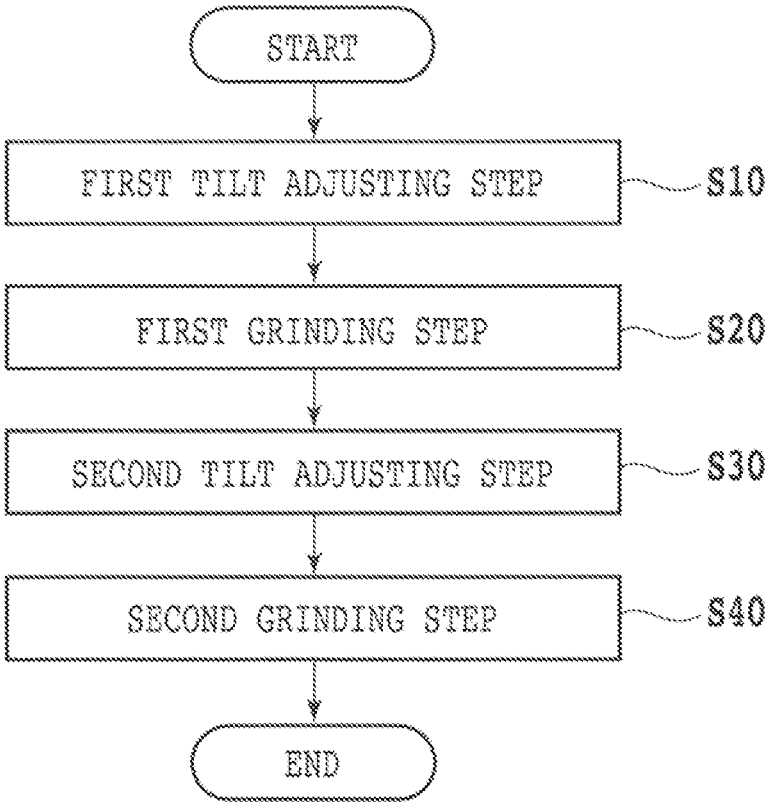
FIG. 8 is a flowchart of a grinding method according to a first embodiment of the present invention.

A grinding method for grinding the workpiece 11 on the grinding apparatus 2 will be described below with reference to FIGS. 3A and 5 through 8. FIG. 8 is a flowchart of a grinding method according to a first embodiment of the present invention. In the grinding method according to the first embodiment, while the holding surface 14*a* is holding the face side 11*a* of the workpiece 11 thereon, the controller 76 controls the tilt adjustment unit 26 to make the grinding surface 70*a* and the local area 14*b* of the holding surface 14*a* parallel to each other (first tilt adjusting step S10).

After the first tilt adjusting step S10, the controller 76 controls the Z-axis moving mechanism 44 to processing-feed the grinding unit 56 downwardly, i.e., along one of the Z-axis directions, to grind the reverse side 11*b* of the workpiece 11 with the grinding wheel 66 while the table base 22 is being tilted as illustrated in FIG. 3A (first grinding step S20). For example, the controller 76 rotates the spindle 60 about its central axis at 4000 rpm and the rotational shaft 16 about its central axis at 300 rpm, and processing-feeds the grinding unit 56 in the Z-axis direction at a processing-feed speed of 0.2 μm/s. In the first grinding step S20, the grinding wheel 66 grinds the reverse side 11*b* of the workpiece 11, and the load detecting unit 24 detects the loads applied to the table base 22. As the grinding goes on, the load current of the servomotor 62 remains unchanged, but the load applied from the grinding unit 56 to the chuck table 10 may increase.

Figure 5:
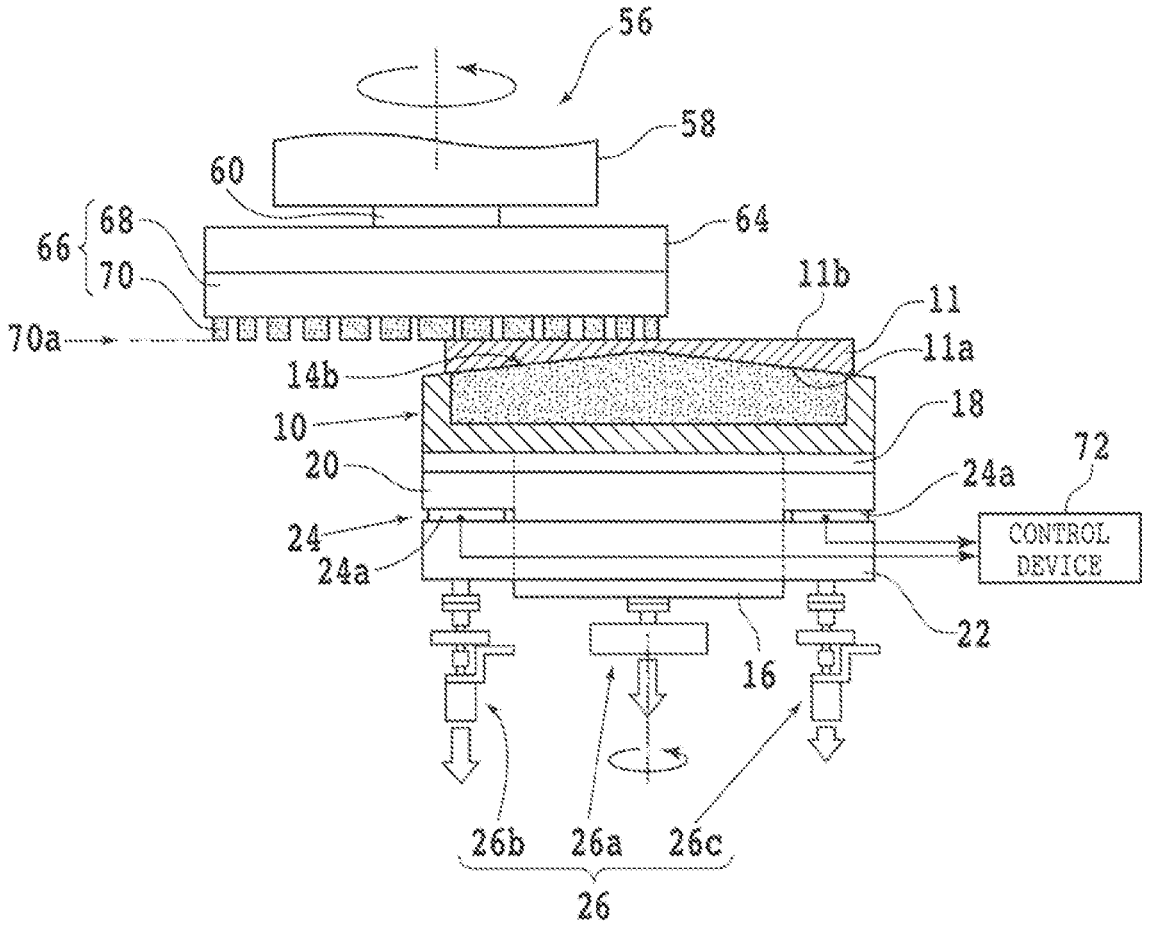
FIG. 5 is a side elevational view, partly in cross section, of the chuck table and other components.

In this case, the grindstones 70 are slipping on the reverse side 11*b* of the workpiece 11, and though the rotational speed of the spindle 60 does not change, the load on the area 13 of contact increases. When the load on the area 13 of contact increases, a larger load is applied to the fixed support mechanism 26*a* and the first movable support mechanism 26*b* as compared to the second movable support mechanism 26*c*. Because of the applied larger load, the contraction of the fixed support mechanism 26*a* and the first movable support mechanism 26*b* becomes larger than the contraction of the second movable support mechanism 26*c*, causing the tilt of the table base 22 to change so that the grinding surface 70*a* and the upper surface of the table base 22 are parallel to each other, for example, as illustrated in FIG. 5. FIG. 5 illustrates in side elevation, partly in cross section, of the chuck table 10 and other components, illustrating the manner in which the grinding surface 70*a* and the upper surface of the table base 22 lie substantially parallel to each other.

If the reverse side 11*b* of the workpiece 11 is continuously ground while the grinding surface 70*a* and the upper surface of the table base 22 lie substantially parallel to each other, the thickness of the central region of the workpiece 11 is reduced too much because of the projecting conical shape of the holding surface 14*a*. An experimental example in which the thickness of the central portion of the workpiece 11 is reduced will be described below. FIG. 6A illustrates a cross-sectional profile of the reverse side 11*b* of the workpiece 11 ground under a grinding load of 30 N, and FIG. 6B illustrates a cross-sectional profile of the reverse side 11*b* of the workpiece 11 ground under a grinding load of 60 N. The grinding loads in FIGS. 6A and 6B represent loads applied to the chuck table 10.

In FIGS. 6A and 6B, the horizontal axis indicates radial positions on the workpiece 11 in a cross-sectional plane across the workpiece 11 through the center thereof and the vertical axis the height (μm) of the reverse side 11*b* as measured by a thickness measuring gauge of the grinding apparatus 2. The zero point on the vertical axis is positioned at a predetermined height from the holding surface 14*a*. As illustrated in FIG. 6A, under the grinding load of 30 N, the central region of the workpiece 11 is higher than the outer circumferential region thereof. According to the cross-sectional profile illustrated in FIG. 6A, the difference between highest and lowest points on the reverse side 11*b* was 0.94 μm.

On the other hand, as illustrated in FIG. 6B, under the grinding load of 60 N, the local area 14*b* of the holding surface 14*a* directly below the area 13 of contact sinks, making the central region of the workpiece 11 lower than the height illustrated in FIG. 6A. According to the cross-sectional profile illustrated in FIG. 6B, the difference between highest and lowest points on the reverse side 11*b* was 0.64 μm. The thickness of the central region of the workpiece 11 is thus reduced as the load on the holding surface 14*a* increases. The reduction in the thickness of the central region of the workpiece 11 is considered to be caused by the upper surface of the table base 22 lying substantially parallel to the grinding surface 70*a* as illustrated in FIG. 5.

According to the present embodiment, in order to prevent the thickness of the central region of the workpiece 11 from being locally reduced, the first grinding step S20 is followed by adjustment of the tilt of the table base 22 based on the loads detected in the first grinding step S20 (second tilt adjusting step S30). In the second tilt adjusting step S30, the controller 76 calculates or reads contractions of the support mechanisms 26*a*, 26*b*, and 26*c* that correspond to the loads detected in the first grinding step S20, using the corresponding relation stored in the storage 74.

Thereafter, the controller 76 controls the stepping motors 32 to relatively adjust the lengths of the support mechanisms 26*a*, 26*b*, and 26*c* so that the change in the tilt of the table base 22 is cancelled out. In this manner, the tilt of the table base 22 is adjusted to restore the tilt of the table base 22 to the one at the time of the first tilt adjusting step S10. For example, in a case where the fixed support mechanism 26*a* and the first movable support mechanism 26*b* are contracted 2 μm in the downward Z-axis direction by the loads applied thereto and the second movable support mechanism 26*c* is contracted 1 μm in the downward Z-axis direction by the load applied thereto, the controller 76 energizes the stepping motor 32 of the second movable support mechanism 26*c* to contract the second movable support mechanism 26*c* further in the downward Z-axis direction by 1 μm.

Further, for example, in a case where the fixed support mechanism 26*a* is contracted 1 μm in the downward Z-axis direction by the load applied thereto and the first movable support mechanism 26*b* is contracted 2 μm in the downward Z-axis direction by the load applied thereto, the controller 76 extends the first movable support mechanism 26*b* by 1 μm in the upward Z-axis direction and contracts the second movable support mechanism 26*c* by 1 μm in the downward Z-axis direction. In the second tilt adjusting step S30, the lengths of the first movable support mechanism 26*b* and the second movable support mechanism 26*c* may be adjusted in the Z-axis directions while the workpiece 11 is being ground, or the workpiece 11 is not being ground, or the grinding wheel 66 is being spaced from the workpiece 11.

After the second tilt adjusting step S30, the reverse side 11*b* of the workpiece 11 is ground under the same conditions as those in the first grinding step S20 to thereby grind the workpiece 11 to a predetermined finished thickness (second grinding step S40). FIG. 7 illustrates the manner in which the workpiece 11 is ground by the grinding apparatus 2 after the tilt of the table base 22 has been adjusted. When the workpiece 11 is ground to the predetermined finished thickness, the material of the workpiece 11 has been removed by a thickness of 10 μm, for example, from the reverse side 11*b* thereof as compared to the state in which it is unground.

According to the present embodiment, the tilt of the table base 22 is adjusted in order to cancel out the change in the tilt thereof in the second tilt adjusting step S30 depending on the loads detected in the first grinding step S20. Thickness variations of the workpiece 11 are thus prevented from becoming worse compared with a case in which the tilt of the table base 22 is not adjusted in the second tilt adjusting step S30. The correlative relation between loads detected by the load detecting unit 24 and changes in the tilt of the table base 22 is not limited to the corresponding relation between the loads applied to the support mechanisms 26*a*, 26*b*, and 26*c* and the contractions of the support mechanisms 26*a*, 26*b*, and 26*c*. Rather, the correlative relation may represent the corresponding relation between the loads applied to the support mechanisms 26*a*, 26*b*, and 26*c* and three-dimensional tilts of the upper surface of the table base 22, for example. The three-dimensional tilts of the upper surface of the table base 22 may be determined by an unillustrated displacement sensor with a built-in camera that automatically detects the tilt of the table base 22 by using an image, a laser displacement meter, a contact-type displacement sensor, or the like, for example.

Figure 9A:
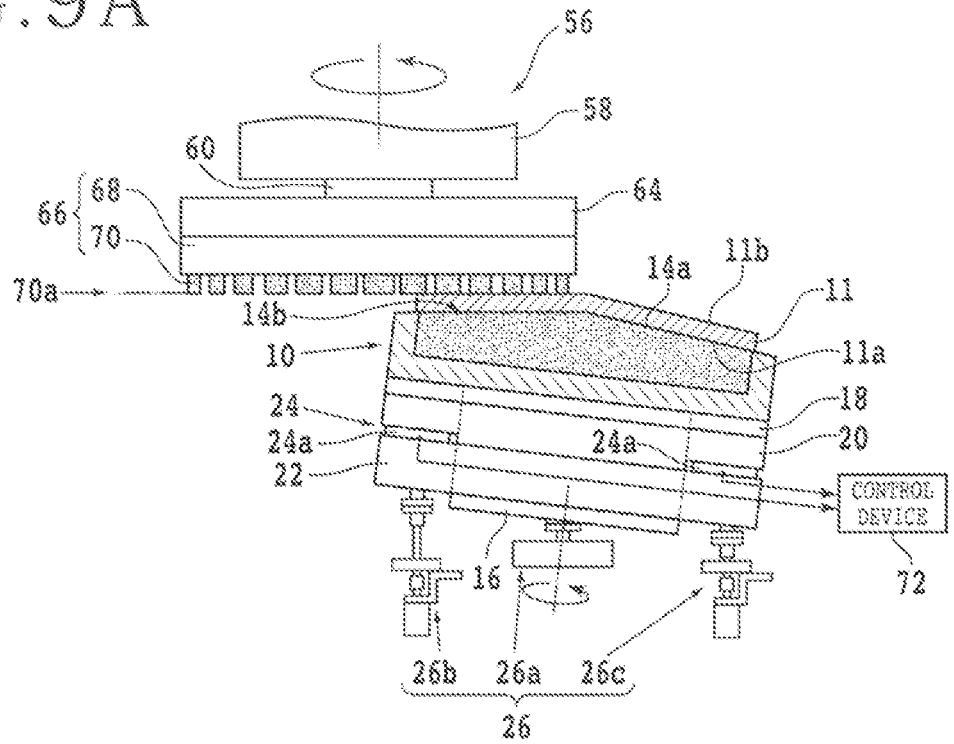
FIG. 9A is a side elevational view, partly in cross section, illustrating the manner in which another workpiece is ground by the grinding apparatus.

A grinding method according to a second embodiment of the present invention will be described below with reference to FIGS. 9A, 9B, and 10. According to the second embodiment, another workpiece 11 that is different from a previously ground workpiece 11 is ground in the same manner as the ground workpiece 11, by using the tilt of the table base 22 that has been adjusted in the second tilt adjusting step S30. According to the second embodiment, specifically, the first tilt adjusting step S10 through the second grinding step S40 are performed on the ground workpiece 11 in the manner described above according to the first embodiment. Then, after the second grinding step S40, the ground workpiece 11 is unloaded from the chuck table 10.

While the lengths of the movable support mechanisms 26*b* and 26*c* remain to have the lengths adjusted in the second tilt adjusting step S30, the face side 11*a* of the other workpiece 11 is held under suction on the holding surface 14*a* of the chuck table 10. Then, the grinding wheel 66 is grinding-fed into contact with the workpiece 11, and grinds the reverse side 11*b* of the workpiece 11 (third grinding step S50). FIG. 9A illustrates the manner in which the other workpiece 11 is ground by the grinding apparatus 2.

According to the second embodiment, since the lengths of the movable support mechanisms 26*b* and 26*c* that have been adjusted in the second tilt adjusting step S30 are used as they are, it is easy or unnecessary for the tilt adjustment unit 26 to adjust the tilt of the table base 22 in the third grinding step S50. In the third grinding step S50, the grinding wheel 66 grinds the other workpiece 11, and the load detecting unit 24 detects the load applied to the table base 22. If the tilt of the table base 22 has changed from the tilt adjusted in the second tilt adjusting step S30, then the tilt of the table base 22 is adjusted (third tilt adjusting step S60).

If the tilt of the table base 22 has not changed from the tilt adjusted in second tilt adjusting step S30, then the third tilt adjusting step S60 may be dispensed with. In the third tilt adjusting step S60, the correlative relation between the loads and the changes in the tilt of the table base 22 is also used. The controller 76 operates the tilt adjustment unit 26 in order to cancel out the change in the tilt of the table base 22 that corresponds to the load detected in the third grinding step S50, on the basis of the correlative relation and the load detected in the third grinding step S50, thereby adjusting the tilt of the table base 22. In this fashion, thickness variations of the workpiece 11 are prevented from becoming worse.

Figure 9B:
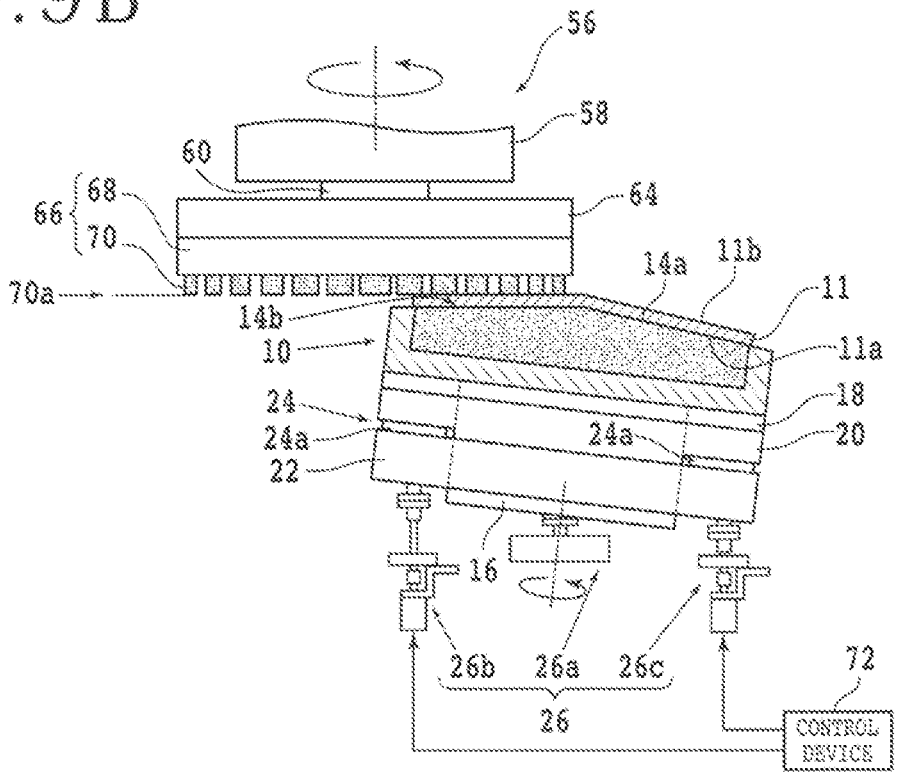
FIG. 9B is a side elevational view, partly in cross section, illustrating the manner in which the tilt of a table base is further adjusted.
Figure 10:
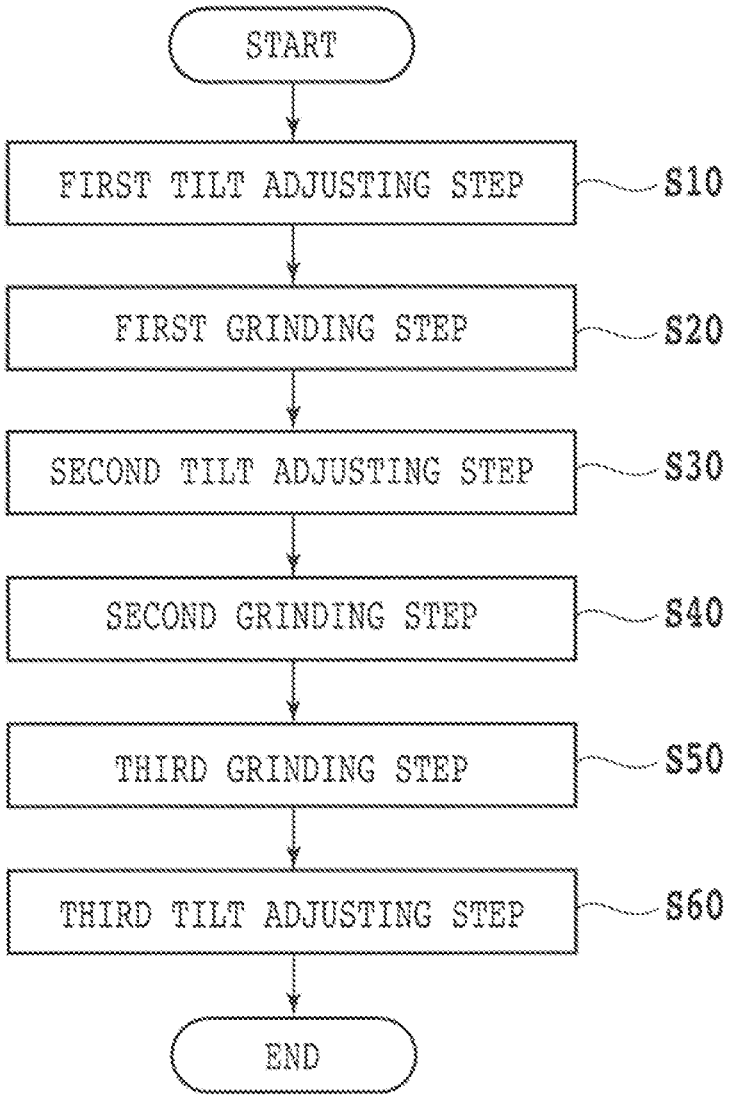
FIG. 10 is a flowchart of a grinding method according to a second embodiment of the present invention.

FIG. 9B illustrates the manner in which the tilt of the table base 22 is further adjusted after the third grinding step S50. After the third tilt adjusting step S60, the other workpiece 11 is ground to the same finished thickness as the previously ground workpiece 11. FIG. 10 is a flowchart of the grinding method according to the second embodiment. According to the second embodiment, thickness variations of the workpiece 11 are prevented from becoming worse compared with a case in which the tilt of the table base 22 is not adjusted in the third tilt adjusting step S60.

The structural details of the grinding apparatus 2 and the grinding methods described above may be changed or modified without departing from the scope of the present invention. For example, the number of the load measuring devices 24*a* is not necessarily limited to three, and may be four or more.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A grinding apparatus for grinding a workpiece, comprising:

a chuck table for holding the workpiece thereon;

a plate-shaped table base supporting the chuck table;

a grinding unit for grinding the workpiece held on the chuck table with a grinding wheel, the grinding unit having a spindle and the grinding wheel mounted on an end of the spindle;

a load detecting unit having load measuring devices, for detecting a load applied from the grinding unit to the table base;

a tilt adjustment unit supporting the table base thereon, for adjusting a tilt of the table base;

a storage for storing a correlative relation between loads applied to the table base and changes in the tilt of the table base that are caused by the loads; and a controller having a processor, for controlling the tilt adjustment unit on a basis of the load detected by the load detecting unit and the correlative relation, to adjust the tilt of the table base so that a change in the tilt of the table base that corresponds to the detected load is cancelled out, wherein the tilt adjustment unit has a fixed support mechanism and a plurality of movable support mechanisms, the correlative relation is determined by loads applied to the fixed support mechanism and the movable support mechanisms and changes in the tilt of the table base that are caused by respective contractions of the fixed support mechanism and the movable support mechanisms to which the loads are applied, and the controller adjusts respective lengths of the movable support mechanisms on a basis of the correlative relation, thereby adjusting the tilt of the table base.

2. A grinding method for grinding a workpiece, comprising:

a first tilt adjusting step of adjusting a tilt of a table base that supports a chuck table, in order to make parallel to each other a grinding surface defined by respective lower surfaces of grindstones of a grinding wheel that are disposed on a surface of a wheel base and arrayed along circumferential directions of the surface of the wheel base and a local area of a holding surface of the chuck table that overlaps an area of contact between the grindstones and the workpiece held on the chuck table;

after the first tilt adjusting step, a first grinding step of grinding the workpiece with the grinding wheel and detecting a load applied to the table base;

after the first grinding step, a second tilt adjusting step of adjusting a tilt of the table base in order to cancel out a change in the tilt of the table base that corresponds to the load detected in the first grinding step, on a basis of a correlative relation between loads applied to the table base and changes in the tilt of the table base that are caused by the loads and the load detected in the first grinding step; and after the second tilt adjusting step, a second grinding step of grinding the workpiece to a predetermined finished thickness, wherein the correlative relation is determined by loads applied to a fixed support mechanism and a plurality of movable support mechanisms and changes in the tilt of the table base that are caused by respective contractions of the fixed support mechanism and the movable support mechanisms to which the loads are applied, the fixed support mechanism and the plurality of movable support mechanisms being configured to adjust the tilt of the table base, and the second tilt adjusting step includes a step of adjusting respective lengths of the movable support mechanisms on a basis of the loads applied to the fixed support mechanism and the movable support mechanisms and the correlative relation.

3. The grinding method according to claim 2, further comprising:

after the second grinding step, a third grinding step of holding another workpiece different from the workpiece and grinding the other workpiece with the grinding wheel while the lengths of the movable support mechanisms remain to have lengths adjusted in the second tilt adjusting step.

4. The grinding method according to claim 3, wherein the third grinding step includes a step of detecting a load applied to the table base as well as grinding the other workpiece with the grinding wheel, and the grinding method further includes a third tilt adjusting step of adjusting the tilt of the table base in order to cancel out a change in the tilt of the table base that corresponds to the load detected in the third grinding step, on a basis of the load detected in the third grinding step and the correlative relation.

5. The grinding apparatus according to claim 1, the load detecting unit comprises a plurality of load cells, for detecting a physical load applied from the grinding unit to the table base.

6. The grinding apparatus according to claim 5, wherein one of the plurality of load cells measures a grinding load at the fixed support mechanism.

7. The grinding apparatus according to claim 6, wherein each load cell measures a grinding force against the fixed support mechanism and the plurality of movable support mechanisms.

8. The grinding apparatus according to claim 2, the load detecting unit comprises a plurality of load cells, for detecting a physical load applied from the grinding unit to the table base.

9. The grinding apparatus according to claim 8, wherein one of the plurality of load cells measures a grinding load at the fixed support mechanism.

10. The grinding apparatus according to claim 9, wherein each load cell measures a grinding force against the fixed support mechanism and the plurality of movable support mechanisms.

11. A grinding apparatus for grinding a workpiece, comprising:

a chuck table for holding the workpiece thereon;

a plate-shaped table base disposed beneath a support plate, supporting the chuck table;

a grinding unit for grinding the workpiece held on the chuck table with a grinding wheel, the grinding unit having a spindle and the grinding wheel mounted on an end of the spindle;

a load detecting unit having load measuring devices, for detecting a load applied from the grinding unit to the table base;

a tilt adjustment unit supporting the table base thereon, for adjusting a tilt of the table base;

a storage for storing a correlative relation between loads applied to the table base and changes in the tilt of the table base that are caused by the loads; and a controller having a processor, for controlling the tilt adjustment unit on a basis of the load detected by the load detecting unit and the correlative relation, to adjust the tilt of the table base so that a change in the tilt of the table base that corresponds to the detected load is cancelled out, wherein the load measuring devices are circumferentially spaced from each other on the upper surface of the table base and have respective upper surfaces held in contact with the lower surface of the support plate.

* * * * *